United States Patent [19]

Mitchell

[11] Patent Number: 4,483,536

[45] Date of Patent: Nov. 20, 1984

[54] DEVICE FOR DETECTION OF SELF-MOVEMENT

[76] Inventor: George H. Mitchell, 2/6 Vickery St., Bentleigh, Victoria, Australia

[21] Appl. No.: 420,244

[22] PCT Filed: Mar. 1, 1982

[86] PCT No.: PCT/AU82/00019

§ 371 Date: Sep. 20, 1982

§ 102(e) Date: Sep. 20, 1982

[87] PCT Pub. No.: WO82/03018

PCT Pub. Date: Sep. 16, 1982

[30] Foreign Application Priority Data

Mar. 3, 1981 [AU] Australia ..... PE7830

[51] Int. Cl.[3] ..... A63B 69/36

[52] U.S. Cl. ..... 273/183 E; 273/DIG. 14

[58] Field of Search ..... 273/183 E, 163 R, 35 A, 273/183 R, 183 B, 190 R; 434/252

[56] References Cited

U.S. PATENT DOCUMENTS 1,556,062 10/1925 Baugh ..... 273/163 R X
2,929,631 3/1960 Gillon ..... 273/163 R
3,000,261 9/1961 Frenkel ..... 273/35 A
3,468,545 9/1969 Anderson ..... 273/183 E

FOREIGN PATENT DOCUMENTS 421685 3/1968 Australia ..... 273/183 E

*Primary Examiner*—George J. Marlo
*Attorney, Agent, or Firm*—Fleit, Jacobson, Cohn & Price

[57] ABSTRACT

A device for detection of self-movement has an optically convergent interface and a substantially linear marker. The convergent interface and linear marker are positioned so that the marker is inclined to, and extends progressively away from, the convergent interface on the same side as the focus or focal line thereof, at least to a position (P) at which the virtual image of the linear marker is significantly further displaced from the convergent interface than is the position (P) in real space. The interface may be a lens in plate or strip form which may be detachably mounted on a base which carries the marker, the base also forming a receptacle for storing the lens when detached. In an alternative embodiment, the device may comprise a solid transparent block with a front face shaped to provide the interface, and with the marker embedded within the block. The device can be used by sportsmen such as golfers to detect body sway during the execution of a stroke.

9 Claims, 7 Drawing Figures

FIG. 4.
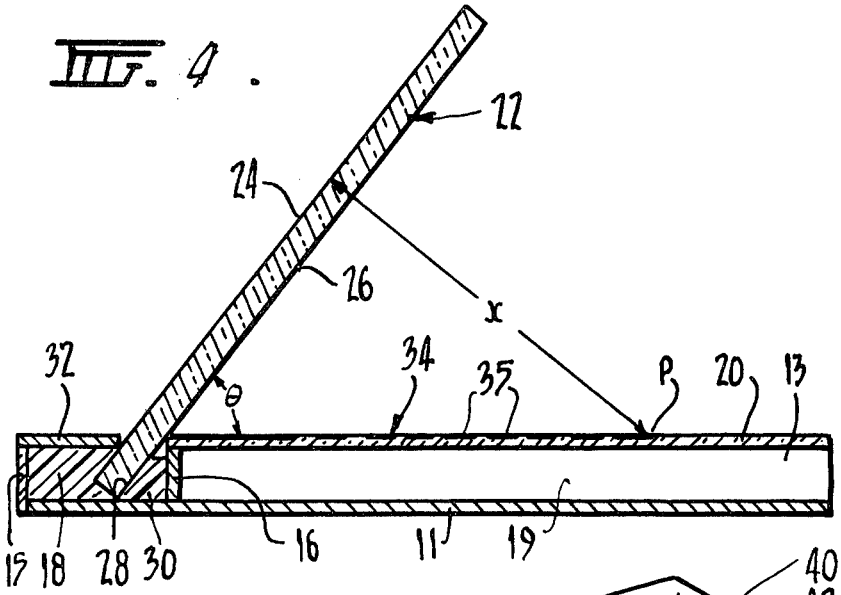
FIG. 5.
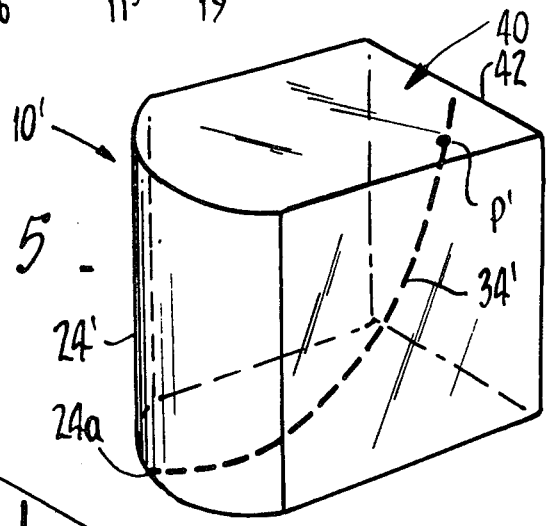
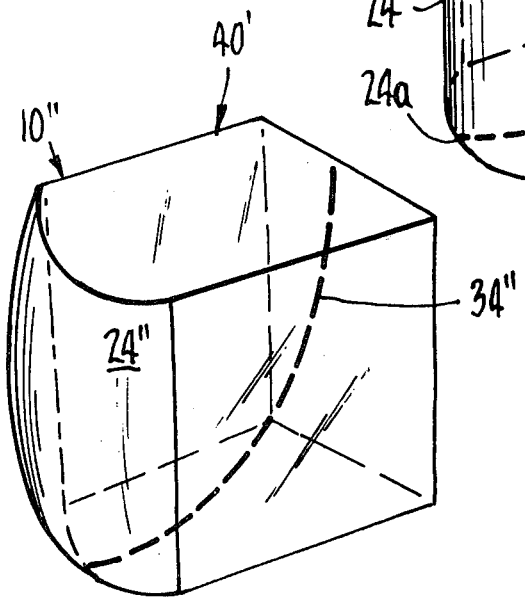
FIG. 6.

DEVICE FOR DETECTION OF SELF-MOVEMENT

TECHNICAL FIELD

This invention relates to the detection of self-movement and in a particular but by no means exclusive application affords sportsmen such as golfers a device by which they are able to detect sway of their body during execution of a stroke.

BACKGROUND ART

It is believed that one of a golfer's principal concerns in perfecting his technique should be to minimise the sideways sway of a notional pivot point in the upper part of his body as he executes the backward and forward swing prior to striking the ball. It is further believed that this theoretically perfect position entails substantially no sideways movement of the eyes during the course of the swing, or at least a consistent slight eye movement characteristic of the golfer. It will be understood that the term "sideways" is being applied in relation to the golfer's torso and corresponds to a fore-and-aft movement relative to the intended line of travel of the ball. It is an objective of this invention to provide a novel device for the detection of self-movement which is especially adaptable as a sway detector for use in golf practice.

DISCLOSURE OF THE INVENTION

The invention accordingly provides a device for detection of self-movement characterized by an optically convergent interface, substantially linear marker means, and positioning means to relatively position the interface and linear marker means so that the marker means extends away from said interface on the same side as the focus or focal line thereof, at least to a position P at which the virtual image of the linear marker means is significantly further displaced from said interface than is the position P in real space.

In a preferred embodiment, said interface is provided by a solid, relatively thin element constituting a lens separated, when in situ, from the marker means by air, and in that the position P is displaced in real space a distance from said interface preferably between 0.4f and f, most preferably between 0.4f and 0.6f, f being the focal length of the lens.

If, alternately, the medium between said interface and said linear marker means is substantially uniform, such as a solid block of substantially transparent material, e.g. perspex, the position P is displaced, in real space, a distance from said interface preferably between 0.4nf and nf, most preferably between 0.4nf and 0.6nf, where n is the refractive index of the medium and f is the focal length of said interface.

The aforesaid lens may be a strip of plastics material having at least one part-cylindrical surface inclined with respect to said marker means whereby the angle between the line of the marker means and the axis of the lens is between 40° and 70°.

BRIEF DESCRIPTION OF DRAWINGS

The invention will be further described, by way of example only, with reference to the accompanying drawings in which:

FIG. 4 is a cross-section on the line 4—4 in FIG. 3A;

FIG. 5 is a diagrammatic representation of an alternative device according to the invention; and FIG. 6 schematically depicts a further, more complex device according to the invention.

MODES FOR CARRYING OUT THE INVENTION

Figure 1:
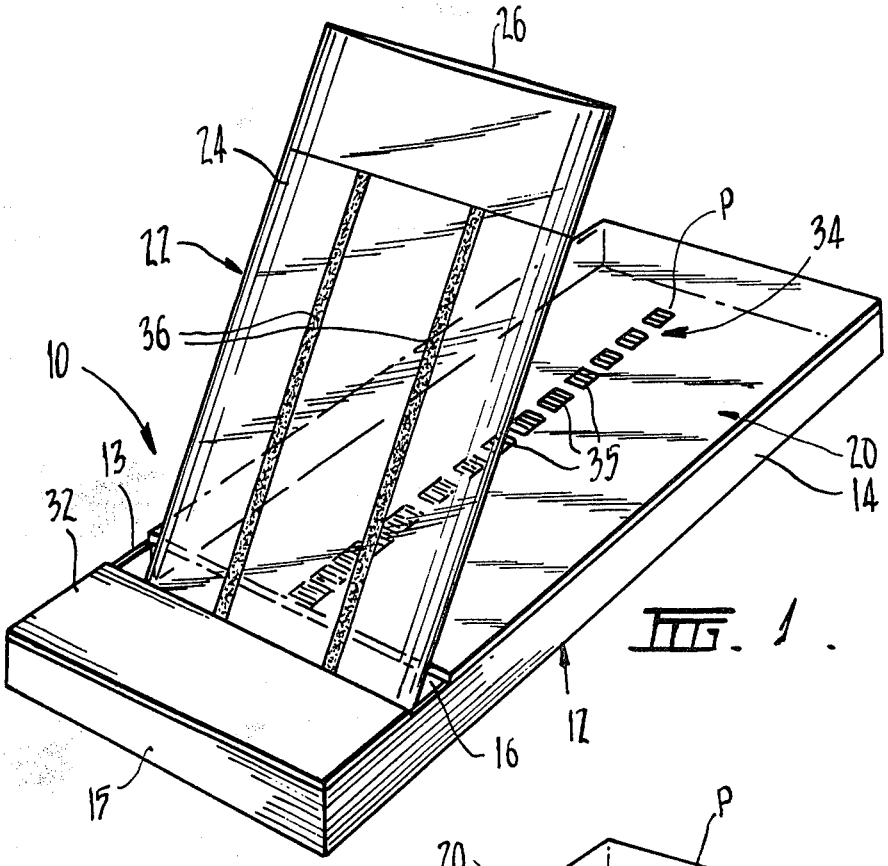
FIG. 1 is a perspective view of a device according to the invention, shown in the assembled condition ready for use by a golfer.
Figure 2:
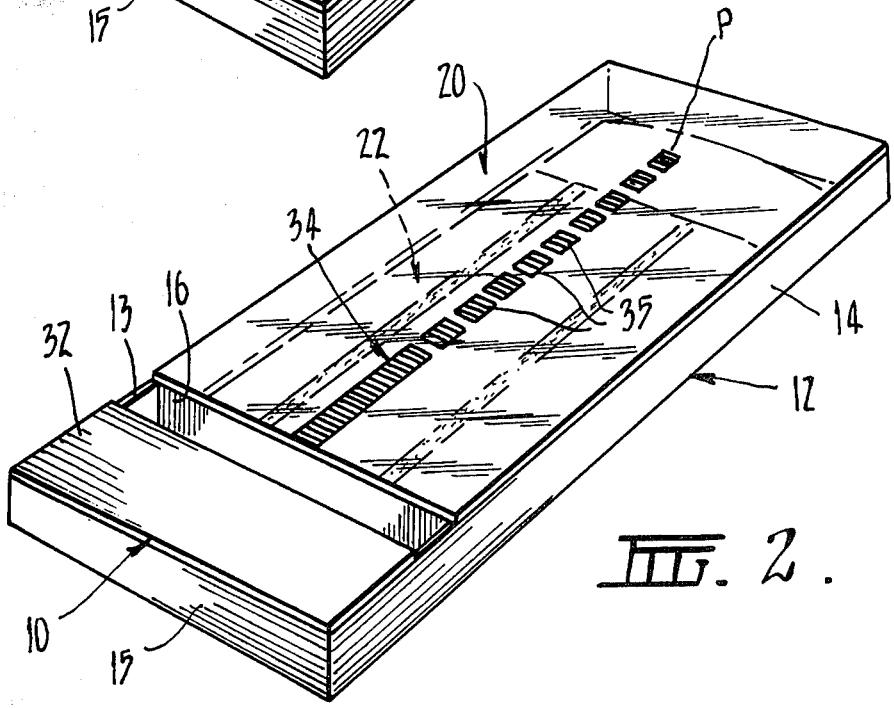
FIG. 2 is a view similar to that of FIG. 1, but showing the transportable condition of the device.

The device 10 illustrated in FIGS. 1 to 4 includes a shallow base 12 having a bottom 11, side walls 13, 14, a front wall 15 and a partition 16 which together define a pair of internal chambers 18, 19 (FIG. 4). Rearward chamber 19, by far the larger of the two, is covered by a transparent plate 20 and so defines a pocket which is open at the rear end of base 12 to snugly receive, for storage, a lens element 22, as best seen in FIG. 2.

Lens element 22 is a relatively thin plate or strip of transparent material, such as for example polymethylmethacrylate, bounded by a part-cylindrical front face 24 constituting an optically convergent interface, and a flat back face 26. The device is assembled for use by withdrawing plate 22 from pocket 19 and operatively mounting it to base 12, by insertion in an inclined groove 28 adjacent partition 16 so that plate 20 is on the same side of lens element 22 as the focal line f of interface 24. Groove 28 is defined by a moulded filling 30 which occupies chamber 18 and is retained by a return 32 at the upper rim of base front wall 15. Return 32 facilitates manual transport of the device without placing the thumb or fingers on the faces of cover plate 20 or lens element 22. In an alternative construction, groove 28 might be formed in an integrally moulded forward end of base 12.

It will be noted that the axis of lens element 22 is inclined at about $\theta$(FIG. 4)=50° to the plane of cover plate 20. Etched or otherwise imprinted on plate 20 and lens element 22 are, respectively, linear marker means 34 and a pair of reference lines 36. Linear marker means 34 comprises a broken, substantially straight line of rectangular markers 35 transversely centred on the top surface of plate 20, Reference lines 36 are unbroken and are desirably of a colour which contrasts with marker line 34. They lie equidistant from the centre line of the lens element.

Applying the lens equation and assuming that the lens element is negligibly thin and is separated from linear marker 34 by air, the position P, as seen by an observer well displaced, of the virtual image of any point A on linear marker 34 at a distance L from interface 12 is given, by:

$$\frac{1}{f} \simeq \frac{n_L - 1}{r} \simeq \frac{1}{L} - \frac{1}{L'} \qquad (1)$$

where L' is the virtual image displacement from interface 24 corresponding to a real displacement L, f and r are respectively the focal length and the radius of curvature of interface 24, and $n_L$ is the relative reference index of the lens element.

By way of example, the following table sets out the virtual image positions L', approximated from equation (1), of points on real linear marker means 34 for various displacements L, assuming $n_L=1.5$ and setting $r=100$ mm to give $f\simeq 200$ mm;

| $L_{(mm)}$ | $L'_{(mm)}$ |
|---|---|
| 20 | 22 |
| 40 | 50 |
| 60 | 83 |
| 80 | 133 |
| 100 | 200 |
| 120 | 300 |
| 150 | 625 |
| 200 (L = f) | infinity |

It will be seen that, in this example, as the linear marker 34 approaches the critical real displacement $L_c$ of 200 mm at which $L=f$, the virtual image of the line appears to the observer to fade off into infinity.

Where an observer is watching two distant objects, one behind the other, sideways movement of the observer will produce parallax, or relative displacement of the objects, dependent upon their relative real separation. Thus, the observer of linear marker 34 will be effectively viewing an object which is rapidly receding into the distance as it approaches $L=L_c$. The parallax, on movement of the observer, between closely spaced virtual image positions approaching a real displacement $L=L_c$ will be substantial since, to the observer, they are well separated in the distance. Hence, fine sideways movement of the observer will produce a marked and very distinct sideways curvature of the viewed image of linear marker 34.

This effect enables the observer to detect his own sideways movement by watching the virtual image of linear marker 34 in lens element 22, and observing sideways curvature of the image. In practice, the degree of curvature produced by the finest movement is very substantial near $L=L_c$, as demonstrated by the above table. Hence, the linear marker 34 is chosen to extend only so far from mounted lens 22 as will produce a practical observable degree of curvature for the selected degree of self-movement which it is desired to detect. For this purpose, it is found in general that the extreme or furthest position P on linear marker 34 is preferably displaced in real space a distance x (FIG. 4) from interface 24 less than f but at least 0.4f and most preferably between 0.4f and 0.6f. It will be appreciated from the table that this choice is made because in this range the displacement of the image of position P from interface 24 becomes significantly greater than the displacement therefrom of P in real space, without rendering the device very sensitive to fine movement.

Figure 3B:
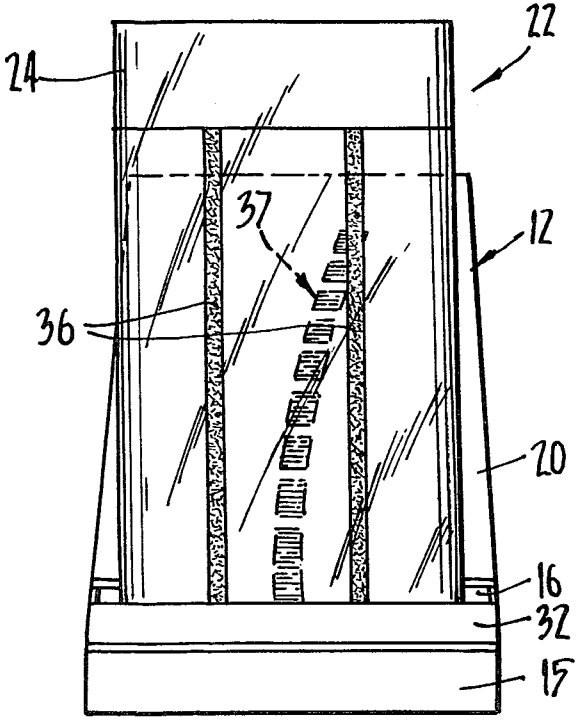
FIGS. 3A and 3B are front elevational views of the device as depicted in FIG. 1, demonstrating the operation of the device in detecting self-movement.
Figure 3A:
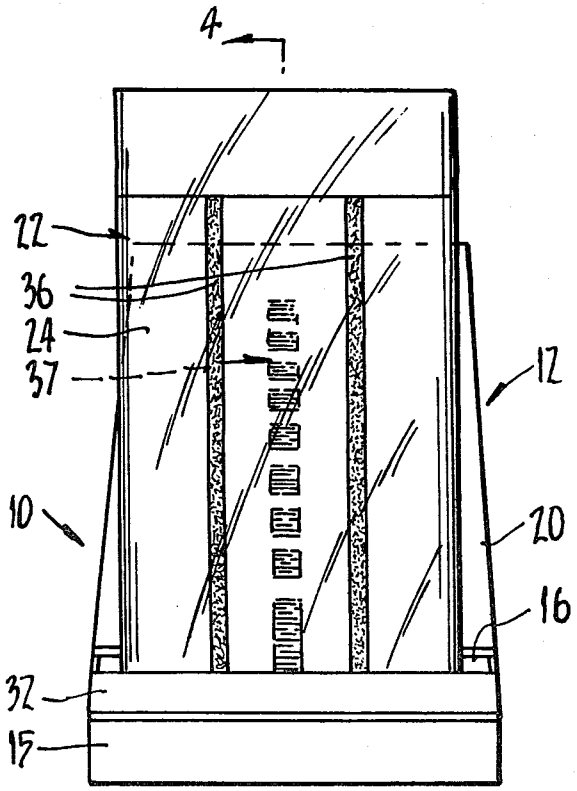

The utility of the device 10 as a golf aid will now be re-iterated with particular reference to FIG. 3. The golfer practising his strokes places the device in front of him on a suitable stand near ground level and prepares himself for his stroke in a position in which his view of the device is the front elevational view shown in FIG. 3A with the image of linear marker 34 at 37. Prior to striking the ball during the course of a theoretically perfect stroke, the notational pivot point in the upper part of his torso should not sway sideways, that is in the fore-and-aft direction relative to the intended line of flight of the ball. As mentioned, it is believed, and accepted for the purpose of the invention, that this entails substantially no sideways movement of the eyes during the course of the swing, or at least a consistent slight eye movement characteristic of the golfer. In observing device 10, a very slight change in his position to one side or the other will produce an observable parallax effect on his view 37 of linear marker 34. The image 37 will curve around to right or left and spread markedly, as depicted in FIG. 3B for a right hand sway. Thus, the golfer can use the device to detect undesirable sway during his swing, whether this be any sway at all or sway outside a consistent pattern which he considers to be allowable for his own successful stroke play. Reference lines 36 aid in suggesting the degree of sway involved.

In the illustrated device, which is intended for use as a golfer's aid to detect self-movement during execution of a swing,, the polymethylmethacrylate lens element 22 has a refractive index $n_L=1.49$, a focal length $f=212$ mm, an outer interface radius $r=106$ mm and a centre line thickness of 6 mm. Extreme position P on linear marker 34 is displaced $x=100$ mm [FIG. 4] from lens interface 24, which equals 0.47f. Reference lines 36 indicate the maximum permissable sideways movement of the average golfer. Lens element inclination $\theta\simeq 50°$ is a compromise to suit different golfers' heights, assuming the device is rested on or near the ground in front of the golfer. The average golfer's line of sight is intended to be about normal to lens interface 24. The angle $\theta$ is typically between 40° and 70° for sporting applications.

Where greater sensitivity is required, such as for a high-standard golfer, the linear marker 34 would be arranged to extend further with respect to f from lens element 22, so that, e.g., $x=0.7$ or 0.8f. This might be achieved by increasing the radius of curvature, and thus focal length, of lens element 22. A given device might be provided with more than one selectable lens elements. Moreover, to prevent excessive lens thickness, it might be necessary to curve both the front and back faces of the lens, that is, to provide a concave-convex lens.

An alternative device 10' illustrated in FIG. 5, comprises a solid block 40 of a suitable substantially transparent plastics material such as polymethylmethacrylate. The block is mounted in any functionally and aesthetically satisfactory manner, not shown for purposes of clarity. Block 40 includes essentially planar upper, lower, side and back surfaces and a convex forward interface 24' of part cylindrical configuration relative to an upright axis. Interface 24' is effectively optically convergent, with an upright focal line within block 40.

Embedded midway between the side faces of block 40 is linear marker means 34' defining a curved coloured line which extends from the region of the lower edge **24*a* of interface 24' to the vicinity of the upper rear corner edge 42 of the block. Line 34' is almost horizontal immediately behind convex interface 24' and curves upwardly to a near vertical alignment adjacent edge 42**, thus receding less rapidly from the lens face with increasing displacement therefrom.

In this case, the lens equation gives:

$$\frac{1}{f}=\frac{n_B-1}{r}=\frac{n_B}{L}-\frac{1}{L'} \qquad (2)$$

where L' is the virtual image displacement from interface 24' corresponding to a real displacement L, f and r are respectively the focal length and radius of curvature of interface 24', and $n_B$ is the relative refractive index of block 40.

The critical displacement $L_c$ from interface 24' at which the virtual image tends to infinity can be determined by rewriting part of equation (2):

$$L' = \frac{Lf}{n_B f - L} \quad (3)$$

from which $L_c = n_B f$ (4)

In this case, an extreme position P' of linear marker 34' is preferably selected so as to be displaced, in real space, a distance from interface 24' between at least $0.4n_B f$ but less than f, advantageously between $0.4n_B f$ and $0.6n_B f$ for most applications.

FIG. 6 depicts a modified device 10'' similar to that of FIG. 5 in which the forward interface 24'' of the block 40' has curvature in all planes and is not merely part-cylindrical. It may be a spherical lens or it may have differing radii of curvature in respective orthogonal directions. This alternative construction has the advantage that the exaggerated parallax effect will occur not only with respect to the image space position of the linear marker 34'' but also in its width.

I claim:

1. A device for detection of self-movement characterized by an optically convergent interface, substantially linear marker means, and positioning means to relatively position the interface and linear marker means so that the marker means is inclined to the interface along a substantial portion of the length of the marker means and extends progressively away from said interface on the same side as the focus or focal line thereof, at least to a position P at which the virtual image of the linear marker means is significantly further displaced from said interface than is the position P in real space.

2. A device according to claim 1 further characterized in that said interface is provided by a solid, relatively thin element constituting a lens separated, when in situ, from the marker means by air, and in that the position P is displaced in real space a distance from said interface between 0.4f and f, f being the focal length of the lens.

3. A device according to claim 2 further characterized in that the position P is displaced, in real space, a distance from said interface between 0.4f and 0.6f, f being the focal length of the lens.

4. A device according to claim 2 further characterized in that the lens is a plate or strip of plastics or glass material having at least one part-cylindrical surface as said interface.

5. A device according to claim 4 further characterized in that the part cylindrical surface is inclined with respect to said linear marker means whereby the angle between the line of the marker means and the axis of the lens is between 40° and 70°.

6. A device according to claim 4 further characterized by a base which carries both said linear marker means and said positioning means, the positioning means being adapted to detachably mount said lens to the base.

7. A device according to claim 6 further characterized in that the base defines a receptacle for storing the detached lens.

8. A device according to claim 1 further characterized in that the medium between said interface and said linear marker means is substantially uniform and in that the position P is displaced, in real space, a distance from said interface between 0.4nf and nf, where n is the refractive index of the medium and f is the focal length of said interface.

9. A device according to claim 8 further characterized in that the position P is displaced, in real space, a distance from said interface between 0.4nf and 0.6nf, where n is the refractive index of the medium and f is the focal length of said interface.

* * * * *